US009901194B1

(12) United States Patent
Fields

(10) Patent No.: US 9,901,194 B1
(45) Date of Patent: Feb. 27, 2018

(54) MODULAR FRAME ASSEMBLY

(71) Applicant: Johnell Fields, Hayward, CA (US)

(72) Inventor: Johnell Fields, Hayward, CA (US)

( * ) Notice: Subject to any disclaimer, the term of this patent is extended or adjusted under 35 U.S.C. 154(b) by 0 days.

(21) Appl. No.: 15/237,177

(22) Filed: Aug. 15, 2016

(51) Int. Cl.
*A47G 1/10* (2006.01)
*A47G 1/06* (2006.01)

(52) U.S. Cl.
CPC ..... *A47G 1/0616* (2013.01); *A47G 1/0605* (2013.01)

(58) Field of Classification Search
CPC ..... A47G 1/0616
USPC ..... 40/780, 781, 791, 741, 732
See application file for complete search history.

(56) References Cited

U.S. PATENT DOCUMENTS 907,648 A * 12/1908 Stottum ..... G09F 7/22 40/489
1,338,258 A 4/1920 Smith
1,385,950 A 7/1921 Petrow
D115,622 S 7/1939 Jewett
3,451,153 A 6/1969 Dohanyos
4,117,614 A 10/1978 Bickford
4,145,827 A * 3/1979 Katsufrakis ..... G09F 15/0006 40/729
4,967,499 A * 11/1990 Rosenberg ..... A47G 1/0605 40/732
5,546,689 A 8/1996 Bornze
6,962,017 B1 * 11/2005 Pounds ..... G09F 1/12 40/781
2010/0043268 A1 2/2010 Powell

FOREIGN PATENT DOCUMENTS

WO WO2008072980 6/2008

* cited by examiner

*Primary Examiner* — Joanne Silbermann

(57) ABSTRACT

A modular frame assembly for being selectively assembled to frame an object includes a plurality of first framing units. A plurality of second framing units is provided. Each of the second framing units removably engages each of the first framing units. Thus, the first framing units and the second framing units form a rectangle. Each of the first framing units and the second framing units frame the object thereby enhancing an ornamental appearance of the object.

8 Claims, 5 Drawing Sheets

MODULAR FRAME ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to frame devices and more particularly pertains to a new frame device for being selectively assembled to frame an object.

BRIEF SUMMARY OF THE INVENTION

An embodiment of the disclosure meets the needs presented above by generally comprising a plurality of first framing units. A plurality of second framing units is provided. Each of the second framing units removably engages each of the first framing units. Thus, the first framing units and the second framing units form a rectangle. Each of the first framing units and the second framing units frame an object thereby enhancing an ornamental appearance of the object.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
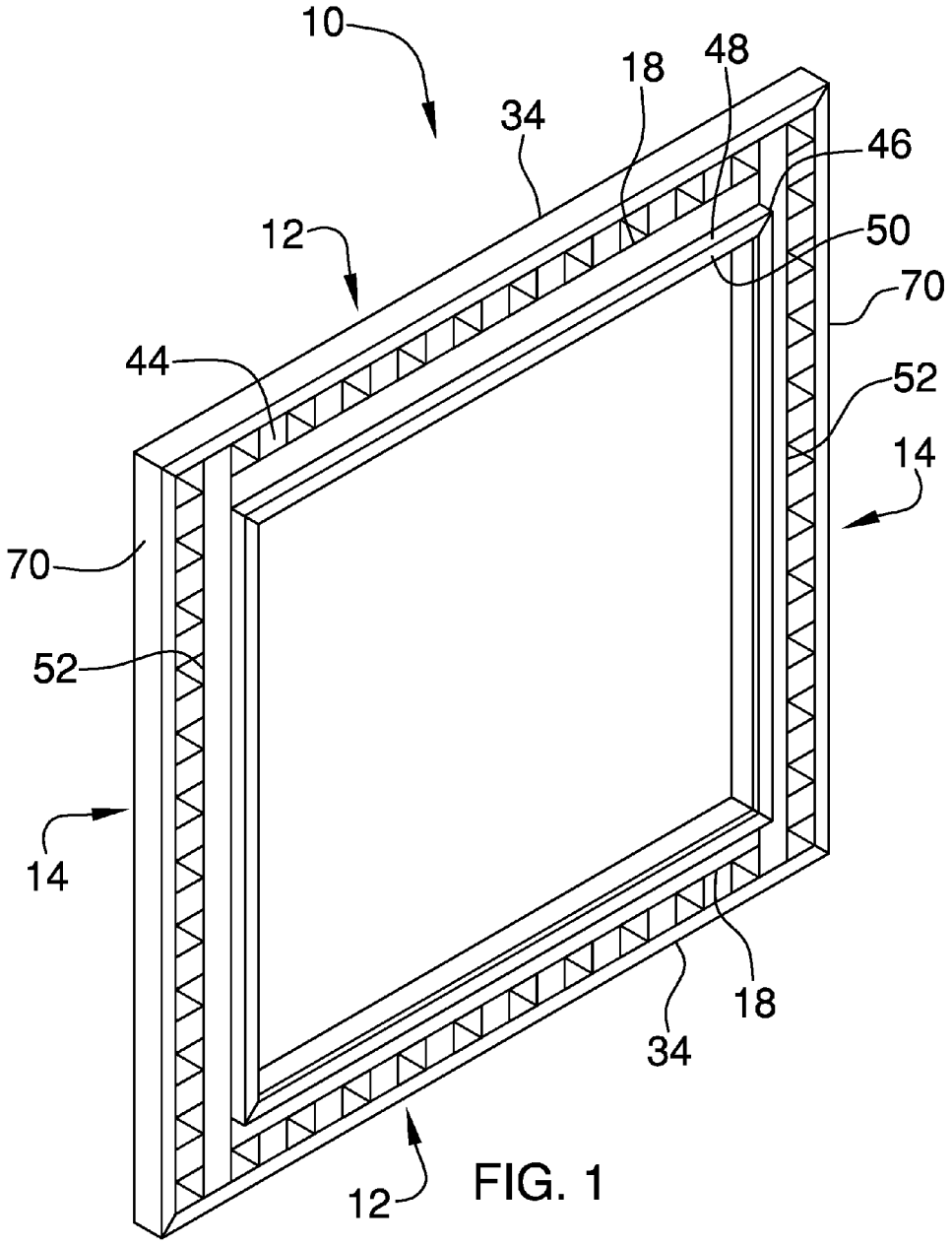
FIG. 1 is a front perspective view of a modular frame assembly according to an embodiment of the disclosure.
Figure 2:
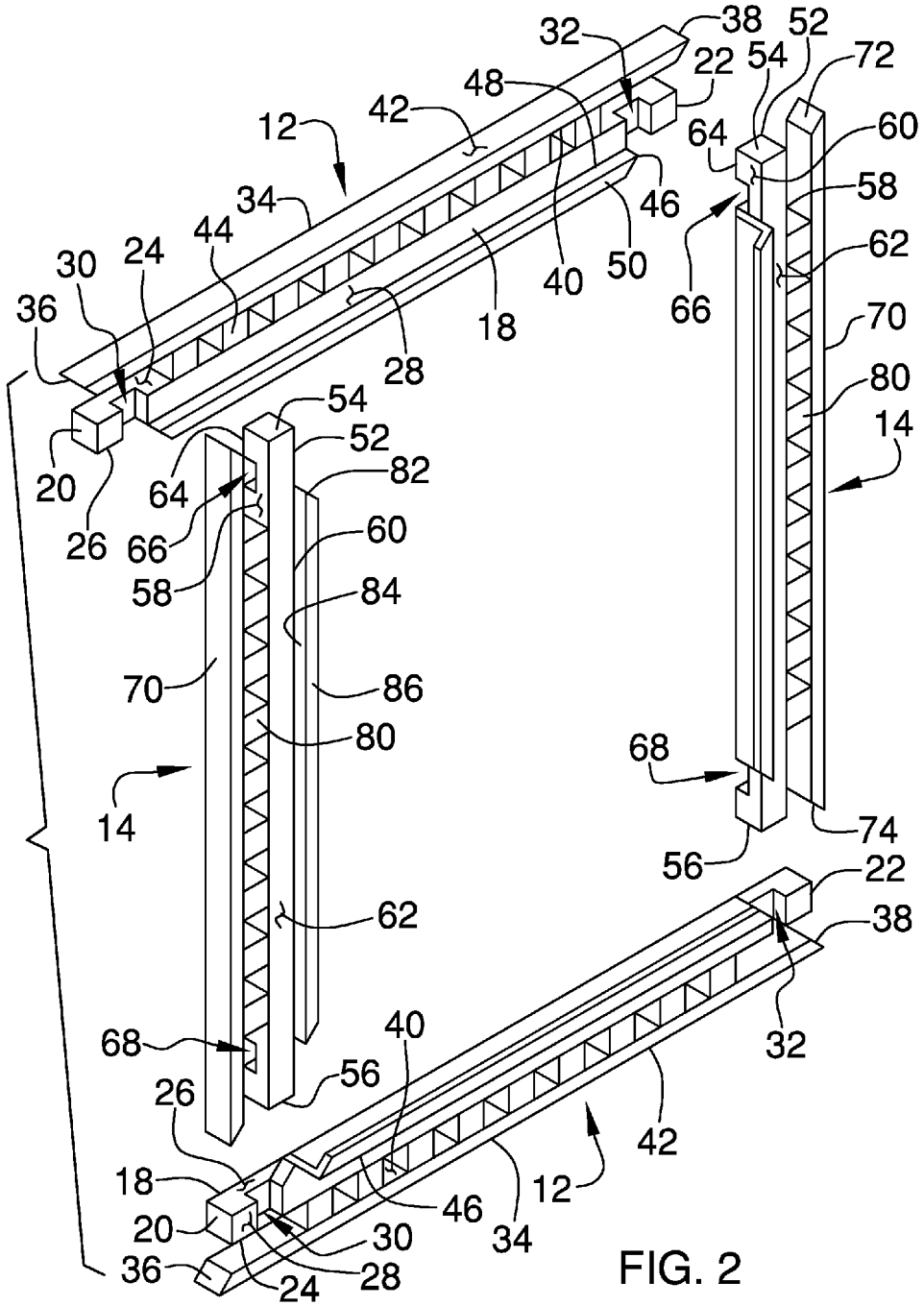
FIG. 2 is an exploded front perspective view of an embodiment of the disclosure.
Figure 3:
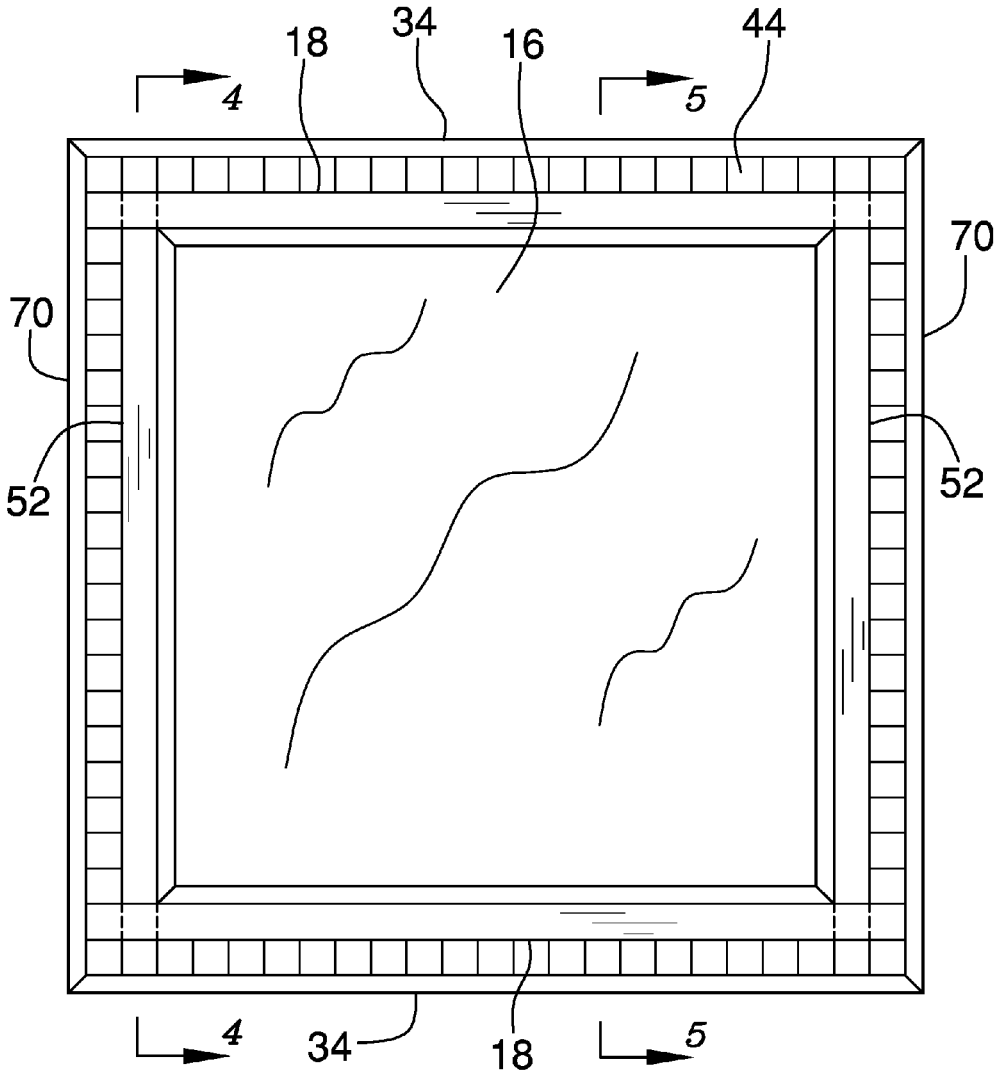
FIG. 3 is a back view of an embodiment of the disclosure.
Figure 4:
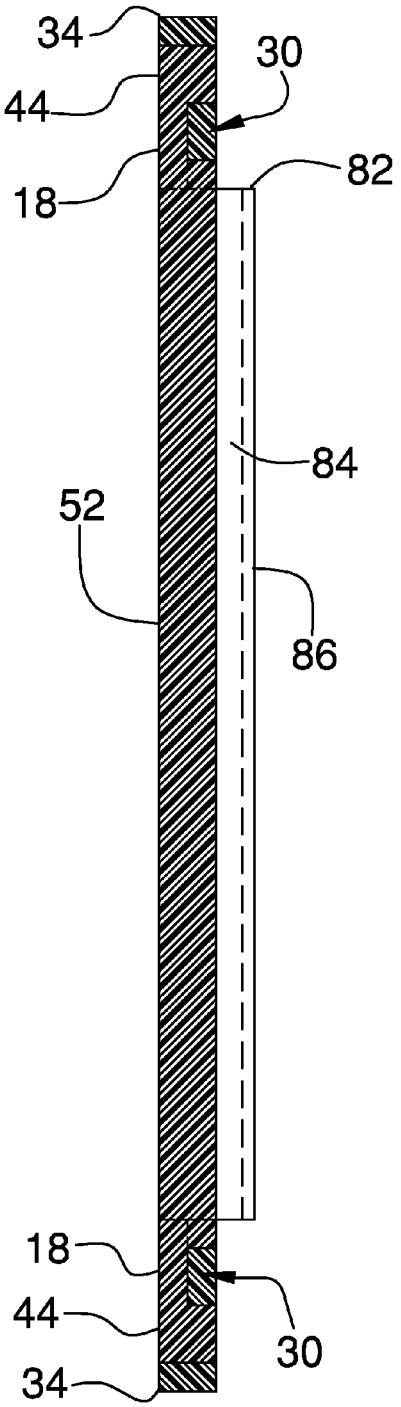
FIG. 4 is a cross sectional view taken along line 4-4 of FIG. 3 of an embodiment of the disclosure.
Figure 5:
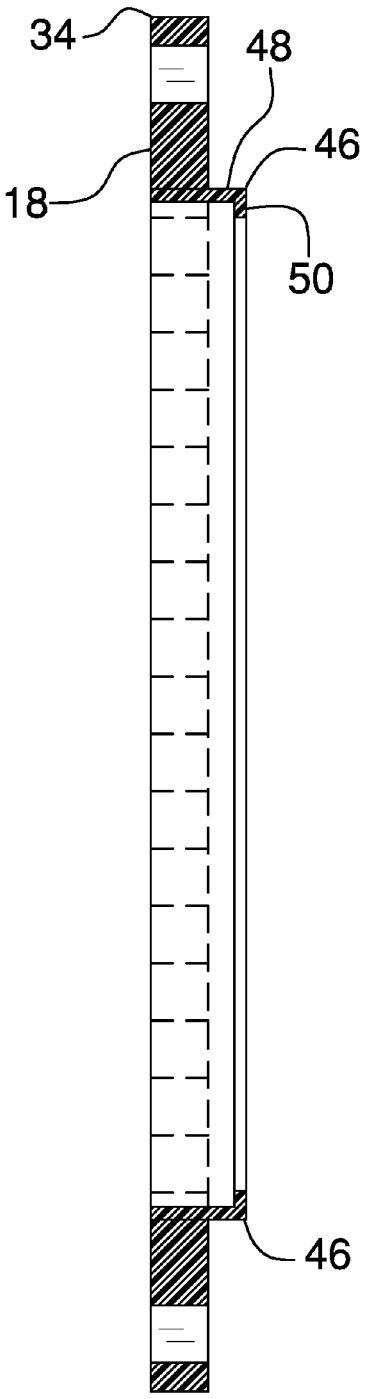
FIG. 5 is a cross sectional view taken along line 5-5 of FIG. 3 of an embodiment of the disclosure.
Figure 6:
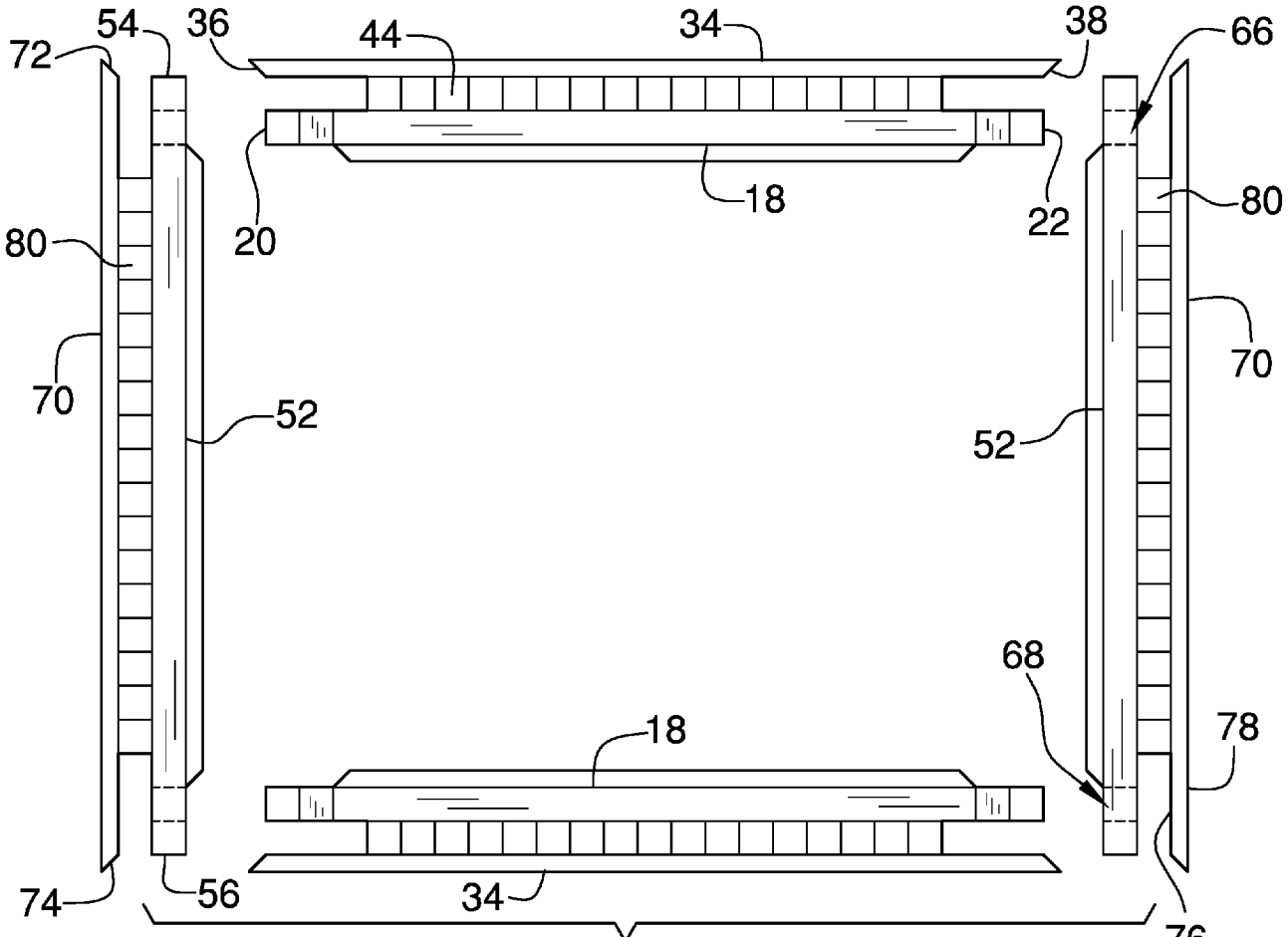
FIG. 6 is an exploded front view of an embodiment of the disclosure.

With reference now to the drawings, and in particular to FIGS. 1 through 6 thereof, a new frame device embodying the principles and concepts of an embodiment of the disclosure and generally designated by the reference numeral 10 will be described.

As best illustrated in FIGS. 1 through 6, the modular frame assembly 10 generally comprises a plurality of first framing units 12. A plurality of second framing units 14 is provided. Each of the second framing units 14 removably engages each of the first framing units 12. Thus, the first framing units 12 and the second framing units 14 form a rectangle.

Each of the first framing units 12 and the second framing units 14 may frame an object 16. Thus, an ornamental appearance of the object 16 is enhanced. The object 16 may be a picture, a mirror or other object 16 commonly surrounded by an ornamental frame. Each of the first framing units 12 may have a length ranging between fifteen cm and ninety cm. Each of the second framing units 14 may have a length ranging between fifteen cm and ninety cm.

Each of the first framing units 12 comprises a first member 18 that has a first end 20 and a second end 22. The first member 18 has a first surface 24, a second surface 26 and a forward facing surface 28 extending between the first surface 24 and the second surface 26. The forward facing surface 28 has a first notch 30 extending therein. The first notch 30 is positioned closer to the first end 20 than the second end 22. The forward facing surface 28 has a second notch 32 extending therein. The second notch 32 is positioned closer to the second end 22 than the first end 20.

A second member 34 is provided. The second member has a primary end 36 and a secondary end 38. The second member 34 has a primary surface 40 and a secondary surface 42. The second member 34 is coextensively spaced from the first member 18 having the primary surface 40 facing the second surface 26. Each of the primary end 36 and the secondary end 38 are chamfered between the primary surface 40 and the secondary surface 42.

A lattice 44 is coupled between the primary surface 40 and the first surface 24. Thus, the first member 18 is coupled to the second member 34. The lattice 44 extends substantially between the first notch 30 and the second notch 32. The lattice 44 may comprise a plurality of spaced blocks or the like.

A moulding 46 is coupled to the first surface 24 of the first member 18. The moulding 46 extends between the first notch 30 and the second notch 32. The moulding 46 has a leg 48 and a foot 50. The leg 48 is positioned on the first surface 24 having the foot 50 extending away from the first surface 24. The foot 50 is spaced from the forward facing surface 28.

Each of the second framing units 14 comprises a first member 52 that has a first end 54 and a second end 56. The first member 52 corresponding to the second framing units 14 has a first surface 58, a second surface 60. The first member 52 corresponding to the second framing units 14 has a front facing surface 62 and a rear facing surface 64 extending between the first surface 58 and the second surface 60 corresponding to the second framing units 14. The rear facing surface 64 has a first notch 66 extending therein. The first notch 66 corresponding to the second framing units 14 is positioned closer to the first end 54 than the second end 56 corresponding to the second framing units 14. The rear facing surface 64 has a second notch 68 extending therein. The second notch 68 corresponding to the second framing units 14 is positioned closer to the second end 56 than the first end 54 corresponding to the second framing units 14.

Each of the second framing units 14 includes a second member 70 that has a primary end 72 and a secondary end 74. The second member 70 corresponding to the second framing units 14 has a primary surface 76 and a secondary surface 78. The second member 70 corresponding to the second framing units 14 is coextensively spaced from the first member 52. The primary surface 76 corresponding to the second framing units 14 faces the second surface 60 corresponding to the second framing units 14. Each of the primary end 72 and the secondary end 74 corresponding to the second framing units 14 is chamfered between the primary surface 76 and the secondary surface 78 corresponding to the second framing units 14.

The first notch 66 corresponding to each of the second framing units 14 engages an associated one of the first notch 30 and the second notch 32 corresponding to each of the first framing units 12. The second notch 68 corresponding to each of the second framing units 14 engages the an associated one of the first notch 30 second notch 32 corresponding to each of the first framing units 12. Thus, each of the second framing units 14 is vertically oriented and each of the first framing units 12 is horizontally oriented. Moreover, the first framing units 12 and the second framing units 14 form a rectangle.

A lattice 80 is coupled between the primary surface 76 and the second surface 60. Thus, the first member 52 corresponding to the second framing units 14 is coupled to the second member 70 corresponding to the second framing units 14. The lattice 80 corresponding to the second framing units 14 extends between the first notch 66 and the second notch 68 corresponding to the second framing units 14. The lattice 80 corresponding to the second framing units 14 may comprise a plurality of spaced blocks or the like.

A moulding 82 is coupled to the first surface 58 of the first member 52 corresponding to the second framing units 14. The moulding 82 corresponding to the second framing units 14 extends between the first notch 66 and the second notch 68 corresponding to the second framing units 14. The moulding 82 corresponding to the second framing units 14 has a leg 84 and a foot 86. The leg 84 corresponding to the second framing units 14 is positioned on the first surface 58 corresponding to the second framing units 14. Moreover, the foot 86 corresponding to the second framing units 14 extends away from the first surface 58 corresponding to the second framing units 14. The foot 86 corresponding to the second framing units 14 is spaced from the front facing surface 62.

In use, the each of the second framing units 14 is removably coupled between each of said first framing units 12. The chamfer on each of the first 12 and second 14 framing units forms a right angle. The object 16 is positioned within the first 12 and second 14 framing units. Thus, each of the first 12 and second 14 framing units enhances the ornamental appearance of the object 16. Each of the second framing units 14 is selectively removed from each of the first framing units 12 for storage. Moreover, each of the first framing units 12 are retained on each of the second framing units 14 without the use of an adhesive or other means of fastening.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A modular frame assembly being configured to frame a picture, said assembly comprising:

a plurality of first framing units;

a plurality of second framing units, each of said second framing units removably engaging each of said first framing units such that said first framing units and said second framing units form a rectangle wherein each of said first framing units and said second framing units are configured to frame an object thereby enhancing an ornamental appearance of the object; and wherein each of said first framing units comprises a first member having a first end and a second end, said first member having a first surface, a second surface and a forward facing surface extending between said first surface and said second surface, said forward facing surface having a first notch extending therein, said first notch being positioned closer to said first end than said second end, said forward facing surface having a second notch extending therein, said second notch being positioned closer to said second end than said first end, a second member having a primary end and a secondary end, said second member having a primary surface and a secondary surface, said second member being coextensively spaced from said first member having said primary surface facing said second surface, each of said primary end and said secondary end being chamfered between said primary surface and said secondary surface, and a lattice being coupled between said primary surface and said first surface such that said first member is coupled to said second member, said lattice extending substantially between said first notch and said second notch.

2. The assembly according to claim 1, further comprising a moulding being coupled to said first surface of said first member, said moulding extending between said first notch and said second notch, said moulding having a leg and a foot, said leg being positioned on said first surface having said foot extending away from said first surface, said foot being spaced from said forward facing surface.

3. The assembly according to claim 1, wherein each of said second framing units comprises a first member having a first end and a second end, said first member corresponding to said second framing units having a first surface, a second surface, a front facing surface and a rear facing surface extending between said first surface and said second surface corresponding to said second framing units, said rear facing surface having a first notch extending therein, said first notch corresponding to said second framing units being positioned closer to said first end than said second end corresponding to said second framing units, said rear surface having a second notch extending therein, said second notch corresponding to said second framing units being positioned closer to said second end than said first end corresponding to said second framing units.

4. The assembly according to claim 3, further comprising a second member having a primary end and a secondary end, said second member corresponding to said second framing units having a primary surface and a secondary surface, said second member corresponding to said second framing units being coextensively spaced from said first member having said primary surface corresponding to said second framing units facing said second surface corresponding to said second framing units, each of said primary end and said secondary end corresponding to said second framing units being chamfered between said primary surface and said secondary surface corresponding to said second framing units.

5. The assembly according to claim 4, further comprising a lattice being coupled between said primary surface and said second surface such that said first member corresponding to said second framing units is coupled to said second member corresponding to said second framing units, said lattice corresponding to said second framing units extending between said first notch and said second notch corresponding to said second framing units.

6. The assembly according to claim 4, further comprising a moulding being coupled to said first surface of said first member corresponding to said second framing units, said moulding corresponding to said second framing units extending between said first notch and said second notch corresponding to said second framing units, said moulding corresponding to said second framing units having a leg and a foot, said leg corresponding to said second framing units being positioned on said first surface corresponding to said second framing units having said foot corresponding to said second framing units extending away from said first surface corresponding to said second framing units, said foot corresponding to said second framing units being spaced from said front facing surface.

7. The assembly according to claim 3, wherein:

each of said second framing members has a first notch and a second notch; and said first notch corresponding to each of said second framing units engaging an associated one of said first notch and said second notch corresponding to each of said first framing units, said second notch corresponding to each of said second framing units engaging an associated one of said first notch and said second notch corresponding to each of said first framing units having each of said second framing units being vertically oriented and each of said first framing units being horizontally oriented.

8. A modular frame assembly being configured to frame a picture, said assembly comprising:

a plurality of first framing units; and a plurality of second framing units, each of said second framing units removably engaging each of said first framing units such that said first framing units and said second framing units form a rectangle wherein each of said first framing units and said second framing units are configured to frame an object thereby enhancing an ornamental appearance of the object, each of said first framing units comprising:

a first member having a first end and a second end, said first member having a first surface, a second surface and a forward facing surface extending between said first surface and said second surface, said forward facing surface having a first notch extending therein, said first notch being positioned closer to said first end than said second end, said forward facing surface having a second notch extending therein, said second notch being positioned closer to said second end than said first end, a second member having a primary end and a secondary end, said second member having a primary surface and a secondary surface, said second member being coextensively spaced from said first member having said primary surface facing said second surface, each of said primary end and said secondary end being chamfered between said primary surface and said secondary surface, a lattice being coupled between said primary surface and said first surface such that said first member is coupled to said second member, said lattice extending substantially between said first notch and said second notch, and a moulding being coupled to said first surface of said first member, said moulding extending between said first notch and said second notch, said moulding having a leg and a foot, said leg being positioned on said first surface having said foot extending away from said first surface, said foot being spaced from said forward facing surface, each of said second framing units comprising:

a first member having a first end and a second end, said first member of corresponding to said second framing units having a first surface, a second surface, a front facing surface and a rear facing surface extending between said first surface and said second surface corresponding to said second framing units, said rear facing surface having a first notch extending therein, said first notch corresponding to said second framing units being positioned closer to said first end than said second end corresponding to said second framing units, said rear surface having a second notch extending therein, said second notch corresponding to said second framing units being positioned closer to said second end than said first end corresponding to said second framing units, a second member having a primary end and a secondary end, said second member corresponding to said second framing units having a primary surface and a secondary surface, said second member corresponding to said second framing units being coextensively spaced from said first member having said primary surface corresponding to said second framing units facing said second surface corresponding to said second framing units, each of said primary end and said secondary end corresponding to said second framing units being chamfered between said primary surface and said secondary surface corresponding to said second framing units, said first notch corresponding to each of said second framing units engaging an associated one of said first notch and said second notch corresponding to each of said first framing units, said second notch corresponding to each of said second framing units engaging an associated one of said first notch and said second notch corresponding to each of said first framing units having each of said second framing units being vertically oriented and each of said first framing units being horizontally oriented, a lattice being coupled between said primary surface and said second surface such that said first member corresponding to said second framing units is coupled to said second member corresponding to said second framing units, said lattice corresponding to said second framing units extending between said first notch and said second notch corresponding to said second framing units, and a moulding being coupled to said first surface of said first member corresponding to said second framing units, said moulding corresponding to said second framing units extending between said first notch and said second notch corresponding to said second framing units, said moulding corresponding to said second framing units having a leg and a foot, said leg corresponding to said second framing units being positioned on said first surface corresponding to said second framing units having said foot corresponding to said second framing units extending away from said first surface corresponding to said second framing units, said foot corresponding to said second framing units being spaced from said front facing surface.

* * * * *